US011078773B2

(12) United States Patent
Idris et al.

(10) Patent No.: US 11,078,773 B2
(45) Date of Patent: Aug. 3, 2021

(54) PERFORMING CONTINUOUS DAILY PRODUCTION ALLOCATION

(71) Applicant: Saudi Arabian Oil Company, Dhahran (SA)

(72) Inventors: Muhammad Idris, Udhailiyah (SA); Ahmed H. Mahsoon, Udhailiyah (SA); Mohammed A. Al-Atwi, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 310 days.

(21) Appl. No.: 16/207,970

(22) Filed: Dec. 3, 2018

(65) Prior Publication Data

US 2020/0173271 A1 Jun. 4, 2020

(51) Int. Cl.

*E21B 47/00* (2012.01)
*E21B 47/06* (2012.01)
*E21B 47/003* (2012.01)

(52) U.S. Cl.

CPC ..... *E21B 47/003* (2020.05); *E21B 47/06* (2013.01)

(58) Field of Classification Search

CPC ..... E21B 43/00; E21B 43/12; E21B 47/003; E21B 47/06; E21B 47/10

See application file for complete search history.

(56) References Cited

U.S. PATENT DOCUMENTS 7,752,023 B2 7/2010 Middya
8,473,268 B2 6/2013 Benish et al.
9,074,465 B2 7/2015 Abivin et al.
2002/0035551 A1* 3/2002 Sherwin ..... G06Q 50/06 705/412
2003/0005747 A1* 1/2003 van der Geest ..... G05B 9/02 73/1.16
2012/0095733 A1* 4/2012 Rossi ..... E21B 43/00 703/2
2016/0333686 A1 11/2016 Scott (Continued)

FOREIGN PATENT DOCUMENTS

WO WO2008002345 1/2008

OTHER PUBLICATIONS

Bokhamseen et al., "Utilization of numerical optimization to model gas condensate flow through chokes in a rich gas condensate reservoir in Saudi Arabia," Nov. 9-12, 2015, Society of Petroleum Engineers, SPE 177694-MS, 13 pages (Year: 2015).*

(Continued)

*Primary Examiner* — Manuel A Rivera Vargas
*Assistant Examiner* — Yaritza H Perez Bermundez
(74) *Attorney, Agent, or Firm* — Fish & Richardson P.C.

(57) ABSTRACT

Computer-implemented systems and computer-implemented methods include the following. A choke/pressure control valve (PCV) gas rate is determined for each well of a group of producing wells. A downstream temperature (DST) gas rate is determined for each well of the group of producing wells. Parameters for a well rate test are determined for each well of the group of producing wells using the choke/PCV gas rate and the DST gas rate. A total gas rate for the producing wells is determined using the parameters. A gas production allocation factor (G-PAF) for the producing wells is determined. A production allocation for each well of the producing wells is determined using the total gas rate.

17 Claims, 7 Drawing Sheets

(56) References Cited

U.S. PATENT DOCUMENTS

2018/0347338 A1* 12/2018 Abbad ..... G01F 1/74
2019/0368916 A1* 12/2019 Al-Abdulwahed ..... E21B 47/10

OTHER PUBLICATIONS

Bokhamseen et al., "Utilization of numerical optimization to model gas condensate flow through chokes in a rich gas condensate reservoir in Saudi Arabia," SPE 177694-MS, Presented at the Abu Dhabi International Petroleum Exhibition and Conference, Abu Dhabi, UAE, Nov. 9-12, 2015; Society of Petroleum Engineers, 2015, 13 pages.
Taiyr et al., "Developing the effective production allocation workflow using different approaches for gas condensate reservoir," SPE 140016, Presented at the SPE Caspian Carbonates Technology Conference, Atyrau, Kazakhstan, Nov. 8-10, 2010; Society of Petroleum Engineers, 2010, 16 pages.
PCT International Search Report and Written Opinion in International Appln. No. PCT/US2019/063989, dated Feb. 27, 2020, 16 pages.
Gilbert, "Flowing and Gas-Lift Well Performance," Drilling and Production Prac., 1954, 32 pages.
Beggs, "Gas Production Operations, section Piping System performance: Flow in Pipelines," Jul. 1984, 333 pages.
GCC Examination Report in GCC Appln. No. GC 2019-38755, dated May 21, 2021, 5 pages.

* cited by examiner

PERFORMING CONTINUOUS DAILY PRODUCTION ALLOCATION

BACKGROUND

The present disclosure applies to gas flowrate calculations and well production allocations.

SUMMARY

The present disclosure describes techniques that can be used for oil and gas wells to perform continuous daily production allocation through a combination of rate measurement and empirical correlations. For example, continuous rate-automation readings can be provided for well production monitoring and daily-monthly production allocation. New correlations that are a function of choke size and downstream temperature can be used to estimate the gas rate, which can provide alternative sources for determining the flowrate. The techniques described in the present disclosure can provide a holistic approach to perform rate-estimation and production allocation processes continuously by calculating the flow parameters readings at surface.

In some implementations, a computer-implemented method, includes: determining a choke/pressure control valve (PCV) gas rate for each well of a group of producing wells; determining a downstream temperature (DST) gas rate for each well of the group of producing wells; determining, using the choke/PCV gas rate and the DST gas rate, parameters for a well rate test for each well of the group of producing wells; determining, using the parameters, a total gas rate for the producing wells; determining a gas production allocation factor (G-PAF) for the producing wells; and determining, using the total gas rate, a production allocation for each well of the producing wells.

The previously described implementation is implementable using a computer-implemented method; a non-transitory, computer-readable medium storing computer-readable instructions to perform the computer-implemented method; and a computer-implemented system comprising a computer memory interoperably coupled with a hardware processor configured to perform the computer-implemented method/the instructions stored on the non-transitory, computer-readable medium.

The subject matter described in this specification can be implemented in particular implementations, so as to realize one or more of the following advantages. First, use of the techniques can improve the reliability and accuracy of production data for wells, and allocation can be increased. Second, a holistic approach can be used to calculate the gas rate as a function of choke, upstream wellhead pressure, downstream wellhead pressure, and downstream temperature. Third, applications can continuously provide a gas flowrate reading for well performance monitoring and well production allocation for gas and oil fields. Fourth, the use of the techniques can minimize the need for well modeling to estimate gas rates. For example, the continuous rate estimation can be performed by combining the measured rate from Venturi meters (or other flow measurement instruments) and the calculated rate using choke and temperature empirical correlations.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

The following detailed description describes techniques for performing continuous daily production allocation through a combination of rate measurements and empirical correlations. For example, the techniques include a comprehensive method and process for determining the gas flow rate on gas wells, then maintaining the reliability of the daily gas rate calculation and well production allocation. As a result, use of the techniques can increase the reliability and accuracy of the well production data, and allocation can increase. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

In some implementations, the techniques can include the use of a new enhanced choke and downstream-temperature empirical equations that can be used to estimate the gas rate using the parameters of choke size, upstream choke pressure, downstream choke pressure, and downstream temperature readings. The estimated gas rate can be used as a first alternative and compared with existing flowrate measurements, for example, obtained from Venturi meters. The techniques can include the use of applications that provide estimated gas rates for individual gas well producers in real time, and that perform a well production allocation process continuously for gas and oil fields.

Figure 1:
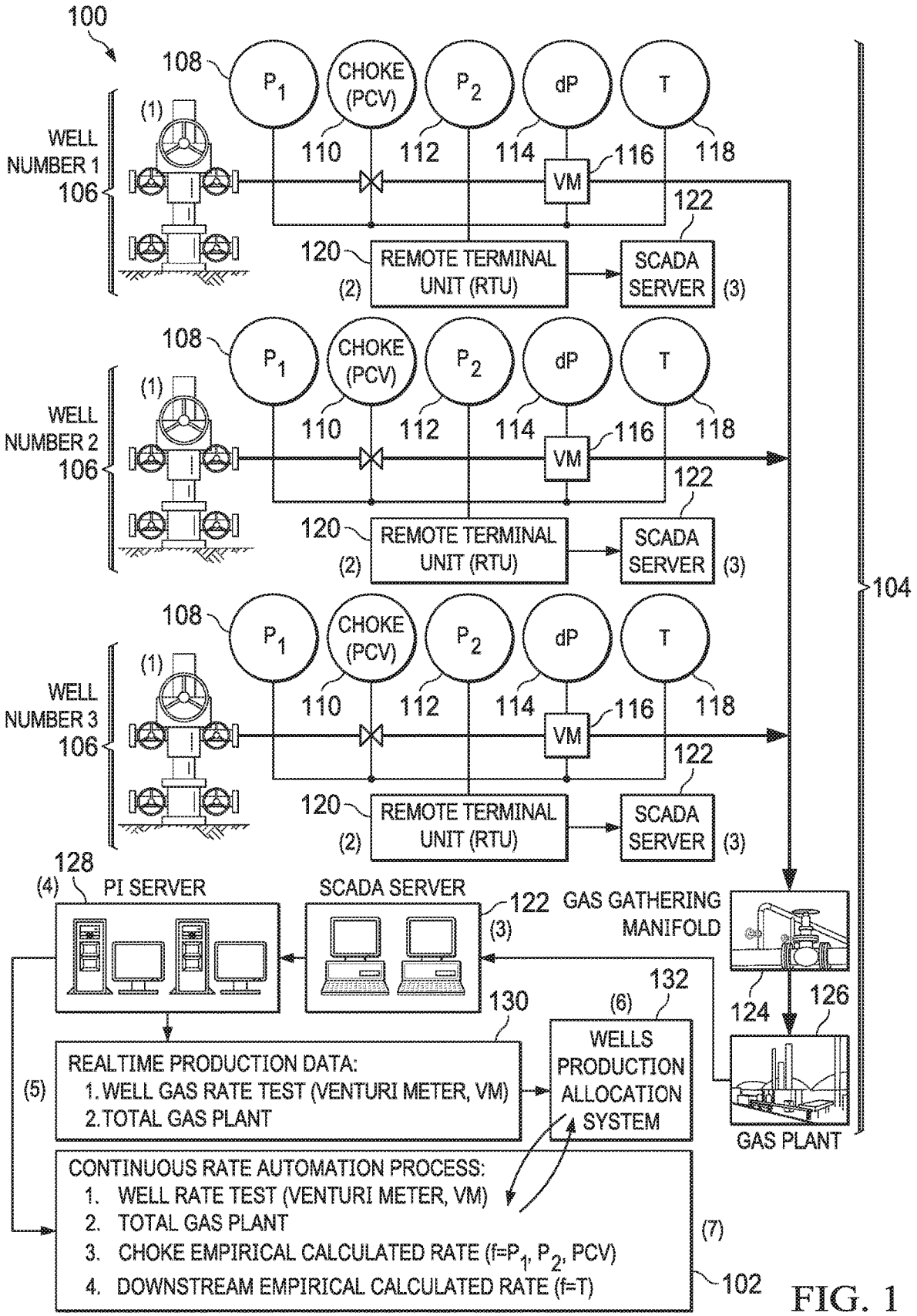
FIG. 1 is a block diagram of example components and operations supporting a continuous rate automation process for well operations, according to some implementations of the present disclosure.

FIG. 1 is a block diagram of example components and operations supporting a continuous rate automation process 102 for well operations 100, according to some implementations of the present disclosure. For example, steps (1)-(6) of conventional process operations 104 include a process of flow measurement for wet gas Venturi meters and production allocation system in gas wells. Step (7) of the continuous rate automation process 102 encompasses the techniques described in the present disclosure. For example, step (7) provides significant improvements over the conventional process operations 104 by maintaining the accuracy of a gas flowrate measurement system and a well production allocation process.

At step (1), each of multiple wells 106 can have its own main flow parameters that may or may not be the same as other wells 106. The main flow parameters include a flowing wellhead pressure ($P_1$) 108, choke or pressure control valve (PCV) 110, a downstream pressure of choke or line pressure ($P_2$) 112, a differential pressure (dP) 114 across a Venturi meter (VM) 116, and a downstream temperature (T) 118. Flow parameter readings can be transmitted to a remote terminal unit (RTU) 120 in the field or a wellsite in real time.

At step (2), the RTU 120 (for example, a microprocessor-controlled electronic device) can interface with the main flow parameters. The RTU 120 can provide readings from the well 106 to a distributed control system, for example, a supervisory control and data acquisition (SCADA) server 122. The RTU 120 can include a programmable logic controller (PLC) that provides functions for automatic well control. The PLC can also can perform flow calculation processes.

At step (3), the SCADA server 122 can receive, in real time or in near-real time, flow parameters and flowrates from the VM 116. The flow rate information that is received by the SCADA server 122 can be used by a field operator to review information and make decisions. For example, the field operator can monitor the well's behavior and can perform gas well production adjustments remotely. In some implementations, SCADA systems can also perform flow calculation processes. Gas that is produced by the well 106 can pass through a gas gathering manifold 124 before arriving at a gas plant 126. The gas plant 126 can provide information to the SCADA server 122.

At step (4), flow rate information, including flow readings, that are received at the SCADA server 122 can be received at a plant information (PI) server 128. The PI server 128 can be part of a PI system, for example. The flow rate information can be used in further production monitoring and surveillance activities, for example, by petroleum engineers or other office base personnel.

At step (5), real-time production data 130 can be generated by the PI server 128. Readings from the PI server 128 can include a gas flowrate (for example, gas rates measured by the VM 116 at wellstream) and a total gas plant production (for example, measured at an inlet gas plant). The real-time production data can be used for well production allocation processes for one or more wells.

At step (6), a wells production allocation system 132 can execute and perform operations. The wells production allocation system 132 can allocate actual gas production to individual wells using calculations based on proportional rates from the VMs 116 and the overall gas plant rate. An estimated rate using the well modeling can be determined even if the VM 116 flowrate for a particular well is unreliable or unavailable.

At step (7), the continuous rate automation process 102 can occur, using inputs from the PI server 128 and information from the wells production allocation system 132. The continuous rate automation process 102 can encompass the techniques described in the present disclosure.

Figure 2:
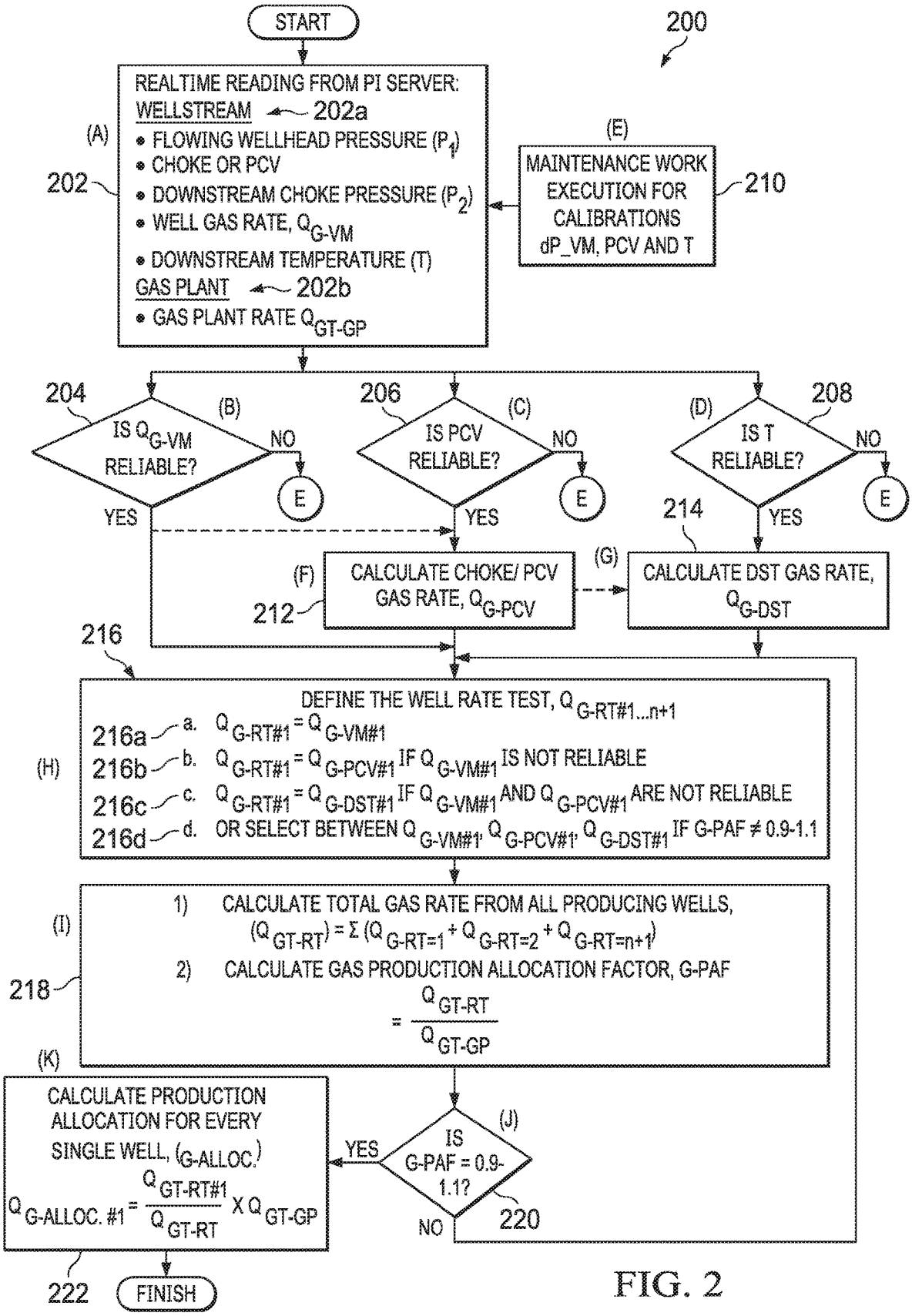
FIG. 2 is a flow diagram of an example of a workflow process for performing continuous daily production allocation, according to some implementations of the present disclosure.

FIG. 2 is a flow diagram of an example of a workflow process 200 for performing continuous daily production allocation, according to some implementations of the present disclosure. The workflow process 200 can correspond to step (7) of FIG. 1, for example.

At 202, data is read in real time from the PI server 128. The data that is read includes parameters that can be grouped into two categories. In a wellstream category 202*a*, the flow parameters read from each of the wells 106 include the $P_1$ 108 (flowing wellhead pressure), the choke or PCV 110, the downstream pressure of choke or line pressure ($P_2$) 112, the $Q_{G\text{-}VM}$ (flowrate of the Venturi meter 116), and downstream temperature (DST). In a gas plant category 202*b*, $Q_{GT\text{-}GP}$ can represent the total actual gas production after a separation process of gas and liquid from all gas wells measured at the inlet of the gas plant.

At 204, a data verification process is begun that also includes steps 206 and 208. The steps 204-208 can be used, for example, to verify the data reliability of the Venturi meter flowrate, PCV, and T, respectively. The data can be considered to be unreliable if, for example: 1) $Q_{G\text{-}VM}=0$ or $Q_{G\text{-}VM}>50$ million standard cubic feet per day (MMSCFD); 2) PCV $\leq 1\%$; or 3) $T>250°$ F. while the well is in flowing condition, and when $P_1\text{-}P_2>50$ pounds per square inch (psi). When unreliable data is detected, the unreliable data can be transferred to (and identified for correction by) a maintenance team for further instrumentation calibration and adjustment. For example, if any of the data is determined to be unreliable in steps 204-208, then step 210 can be used to perform maintenance work for calibrations of $dP_{VM}$, PCV, and T.

At 212, choke/PCV and flow calculations are performed. For example, the choke gas rate can be calculated as a function of PCV, $P_1$, and $P_2$. The flowrate trend of the Venturi meter can be considered for rate-matching with the choke rate as necessary. In some implementations, the choke gas rate ($Q_{G\text{-}PCV}$) can be calculated using Equation (3) below.

At 214, DST flow calculations can occur. The DST gas rate can be calculated based on the value of downstream temperature. The flowrate trend of the Venturi meter can be considered for rate-matching with the DST rate as necessary. In some implementations, the DST gas rate ($Q_{G\text{-}DST}$) can be calculated using Equation (5) below.

At 216, well rate test values are defined. For example, a selection for $Q_{G\text{-}RT\ \#1}$ can be based on the reliability of certain values. In a selection alternative 216*a*, $Q_{G\text{-}RT\ \#1}$ can be set to $Q_{G\text{-}VM\ \#1}$ (for example, if $Q_{G\text{-}VM\ \#1}$ is reliable). Alternatively, in a selection alternative 216*b*, $Q_{G\text{-}RT\#1}$ can be set to $Q_{G\text{-}PCV\#1}$ (for example, if $Q_{G\text{-}VM\#1}$ is not reliable). In a selection alternative 216*c*, $Q_{G\text{-}RT\#1}$ can be set to $Q_{G\text{-}DST\#1}$ (for example, if $Q_{G\text{-}VM\#1}$ and $Q_{G\text{-}PCV\#1}$ are not reliable). In a selection alternative 216*d*, $Q_{G\text{-}RT\ \#1}$ can be set to one of $Q_{G\text{-}VM\#1}$, $Q_{G\text{-}PCV\#1}$, or $Q_{G\text{-}DST\#1}$ (for example, if Q-PAF is not within a range of 0.9 to 1.1). Each of the wells 106 can be assigned a final rate test based on the reliability of flowrate readings from the Venturi meter, the choke/PCV rate, and the DST rate. After the well rate test values are defined the selected rate test can be used for calculating the total gas production from all producing wells.

At 218, total production is calculated based on the production of all of the wells 106. For example, the total well production can be determined from a summation (of all wells 106) from the well rate test from step 216 as $Q_{GT\text{-}RT}$, such as given by $Q_{GT\text{-}RT}=\Sigma(Q_{G\text{-}RT\#1}+Q_{G\text{-}RT\#2}+Q_{G\text{-}RT\#n+1})$. Then, the gas production allocation factor (G-PAF) can be calculated by dividing $Q_{GT\text{-}RT}$ by $Q_{GT\text{-}GP}$.

At 220, verification of production allocation factor process occurs. For example, a determination is made that G-PAF is within an acceptance range between 0.9 and 0.11 (for example, within an error of ±10%). If G-PAF factor is out of the 0.9-1.1 range, for example, then step 216 is repeated to re-define the well rate test.

At 222, individual well production allocation occurs. For example, the actual allocated gas production for each individual well ($Q_{G\text{-}Alloc}$) can be prorated based on the total well rate test and the total actual production multiplied by the rate test for each well.

Example results of using the workflow process 200, including the continuous rate automation process system, are provided in Table 1 and Table 2.

TABLE 1

Calculated Rate Methods Using Choke/PCV and DST Correlations

| | Normalized Reading | | | | | | | |
|---|---|---|---|---|---|---|---|---|
| Well | P1 | PCV | P2 | T or DST | $Q_{G\text{-}VM}$ | $Q_{G\text{-}PCV}$ | $Q_{G\text{-}DST}$ | $Q_{G\text{-}RT}$ |
| WELL#1 | 3.0 | 2.4 | 1.2 | 1.1 | 1.9 | 2.2 | 1.9 | 1.9 |
| WELL#2 | 2.5 | 2.1 | 1.0 | 1.5 | 1.8 | 1.8 | 1.6 | 1.8 |
| WELL#3 | 3.0 | 1.4 | 1.0 | 1.3 | 1.4 | 1.4 | 1.3 | 1.4 |
| WELL#4 | 6.0 | 1.0 | 1.0 | 1.0 | 2.2 | 2.3 | 2.0 | 2.2 |
| WELL#5 | 2.8 | N/R | 1.1 | 1.4 | 2.3 | N/R | 2.2 | 2.3 |
| WELL#6 | 2.9 | 1.5 | 1.2 | 2.2 | N/R | 2.9 | 3.2 | 2.9 |
| WELL#7 | 4.1 | 1.2 | 1.7 | 1.6 | 1.9 | 1.8 | 1.9 | 1.9 |
| WELL#8 | 1.6 | 2.7 | 1.0 | 1.6 | 1.1 | 1.1 | 1.2 | 1.1 |
| WELL#9 | 1.8 | N/R | 1.1 | 1.6 | N/R | N/R | 3.8 | 3.8 |

In Table 1, the $Q_{G\text{-}RT}$ is the continuous rate-automation reading resulting from the combination of Venturi meter, the choke/PCV calculated rate, and the DST calculated rate. Some values in Table 1 are indicated as not reliable (N/R).

TABLE 2

Results of Using Gas Production Allocation Factor (G-PAF)

| | Conventional Method Venturi Meter vs Gas Plant | | | Method of Present Disclosure Continuous Rate-Automation vs Gas Plant | | |
|---|---|---|---|---|---|---|
| Month | # Wells (Manual Est.)* | AAE** | G-PAF | # Wells (Manual Est.)* | AAE** | G-PAF |
| #1 | 3 | 6% | 0.94 | — | 5% | 0.95 |
| #2 | 3 | 6% | 0.94 | — | 3% | 0.97 |
| #3 | 6 | 8% | 0.92 | — | 7% | 0.93 |
| #4 | 7 | 8% | 0.92 | — | 5% | 0.95 |
| #5 | 3 | 6% | 0.94 | — | 6% | 0.94 |
| #6 | 4 | 9% | 0.91 | — | 7% | 0.93 |
| #7 | 4 | 11% | 0.89 | — | 7% | 0.93 |
| #8 | 3 | 5% | 0.95 | — | 3% | 0.97 |
| #9 | 3 | 5% | 0.95 | — | 4% | 0.96 |
| #10 | 4 | 3% | 0.97 | — | 5% | 0.95 |
| Average | 4 | 7% | 0.93 | — | 5% | 0.95 |

In Table 2, *indicates a number of wells that required well modeling for rate estimation due to the Venturi meter not being reliable, and **indicates an average absolute error. As shown in Table 2, the G-PAF is enhanced from 0.93 (7% error) to 0.95 (5% error).

In some implementations, the following choke/PCV-flow calculation equations can be used, for example, to support the calculations used in the workflow process 200.

A critical flow condition (for example, $P_{ratio}\leq 0.75$) can be given by Equation (1):

$$Q_{G_choke}=\frac{D_{64}^{1.8773}*P_1}{[0.4438*10^6]*CGR^{[0.099*ln(CGR)-0.6641]}} \tag{1}$$

where $Q_{G_choke}$ is a gas choke flowrate, CGR is a condensate to gas ratio (CGR), $D_{64}$ is a choke size, and $P_1$ is the flowing wellhead pressure or upstream choke pressure.

Equation (1) is an enhanced correlation developed for the present disclosure and can be used to estimate the gas flowrate based on the fixed-choke size in (for example, 64 inches) for the critical flow condition.

A gas flowrate can be calculated using Equation (2):

$$Q_{G_PCV}=\frac{[C_F*\{a*PCV+b*PCV^2+c*PCV^3\}]^{1.8773}*P_1}{[0.4438*10^6]*CGR^{[0.099*ln(CGR)-0.6641]}} \tag{2}$$

where $Q_{G_PCV}$ is the calculated gas flowrate using choke equations, $C_F$ is a correction factor based on the rate-matching with the Venturi meter's rate, PCV is the pressure control valve, and a, b, and c are constants. Equation (2) is similar to Equation (1) and can be used to estimate the gas flowrate, but is further based on the choke size using the PCV (for example, measured in percentage of valve opening).

A sub-critical flow condition (for example, $P_{ratio}>0.75$) can be given by Equation (3):

$$Q_{G_choke}=\frac{D_{64}^{1.8277}}{[0.2323*10^6]*CGR^{[0.0999*ln(CGR)-0.6641]}}\sqrt{(P_1^2-P_2^2)} \tag{3}$$

where $P_2$ is the downstream choke pressure or line pressure. Equation (3) can be used to estimate the gas flowrate for the flow in sub-critical conditions. Equation (3) can be created by modifying conventional correlation equations.

An example equation for estimating the gas flowrate is provided in Equation (4):

$$Q_{G_PCV}=\frac{[C_F*\{a*PCV+b*PCV^2+c*PCV^3\}]^{1.8277}}{[0.2323*10^6]*CGR^{[0.099*ln(CGR)-0.6641]}}\sqrt{(P_1^2-P_2^2)} \tag{4}$$

where $Q_{G_PCV}$ is the calculated gas flowrate using choke equations. Equation (4) is similar to Equation (3) and can be used to estimate the gas flowrate but is further based on the choke size using the PCV which is in percentage of the valve opening. Equations (1) to (4) can be validated with actual gas rate measured by 3-phase separator test and a Venturi meter, with example results shown in FIGS. 3 and 4.

Equation (5) can be used as a downstream temperature-flow calculation equation:

$$Q_{G_{DST}}=C_F*[15.039*CGR^{-0.695}]*e^{[0.021*T]} \quad (5)$$

where $Q_{G_{DST}}$ is the calculated gas flowrate using downstream equations, and T is the downstream temperature. Equation (5) is a new empirical correlation that can be used to estimate the gas rate as function of downstream temperature. This equation is based on the actual measurement using the 3-phase separator test. Example rate validation analysis is provided in FIG. 5.

Terms used in and supporting equations in this disclosure are summarized in Table 3.

TABLE 3

Equation Terms and Descriptions

| Term | Description | Units |
|---|---|---|
| E | $\text{Error} = \frac{[\text{Calculated rate} - \text{Measured rate}]}{\text{Measured rate}}$ | percentage |
| AE | $\text{Average Error} = \frac{\sum E_i}{n}$ | |
| AbsE | Absolute error = Abs[E] or = \|E\| | percentage |
| AAE | $\text{Average Absolute Error} = \frac{\sum \lvert E_i \rvert}{n}$ | percentage |
| CF | Correction factor based on the rate-matching with Venturi meter's rate | dimensionless |
| CGR | Condensate to Gas Ratio | Stock tank barrels (stb)/MMSCF |
| $D_{64}$ | Choke size | 1/64 inches |
| dP_VM | Differential pressure of Venturi meter | in-water |
| DST | Downstream temperature | Degrees Fahrenheit (° F.) |
| G-PAF | Gas production allocation factor | fraction |
| i | 1, 2, 3, . . . n | |
| n | The number of data test points used in the analysis | |
| $Q_G$ | Gas flowrate | MMSCFD |
| $Q_{G\text{-}Alloc.}$ | Allocated gas flowrate | MMSCFD |
| $Q_{G\text{-}DST}$ | Calculated gas flowrate using downstream temperature equations | MMSCFD |
| $Q_{GT\text{-}GP}$ | Total gas production at gas plant point | MMSCFD |
| $Q_{G\text{-}PCV}$ | Calculated gas flowrate using choke_PCV equations | MMSCFD |
| $Q_{G\text{-}RT}$ | Gas well rate test | MMSCFD |
| $Q_{GT\text{-}RT}$ | Total gas wells rate test | MMSCFD |
| $Q_{G\text{-}VM}$ | Gas flowrate of Venturi meter | MMSCFD |
| $P_1$ | Flowing wellhead pressure or upstream choke pressure | psi |
| $P_2$ | Downstream choke pressure or line pressure | psi |
| PCV | Pressure control valve | percentage |
| $P_{ratio}$ | $\text{Pressure ratio between } P_2 \text{ and } P_1 = \frac{P_2}{P_1}$ | fraction |
| SD | $\text{Standard deviation} = \sqrt{\frac{\sum[(E_i * 100) - (AE * 100)]^2}{n-1}}$ | — |
| T | Downstream temperature | ° F. |
| VM | Venturi meter | — |

Table 4 lists values for constants a, b, and c that are used for correlations in the Equations.

TABLE 4

PCV Constants

| Constant | PCV Correlation #1 | PCV Correlation #2 | PCV Correlation #3 | PCV Correlation #4 |
|---|---|---|---|---|
| a | 2.25 | 1.475530116 | 1.07 | 0.633 |
| b | −0.0235 | −0.00975419 | −0.00314053 | 0.00 |
| c | 0.00008 | 0.0000137 | −0.000017 | 0.00 |

In Table 4, the selection of a particular PCV Correlation #1, 2, 3, or 4 can be subjected to the rate-matching with Venturi meter's rate.

Figure 3:
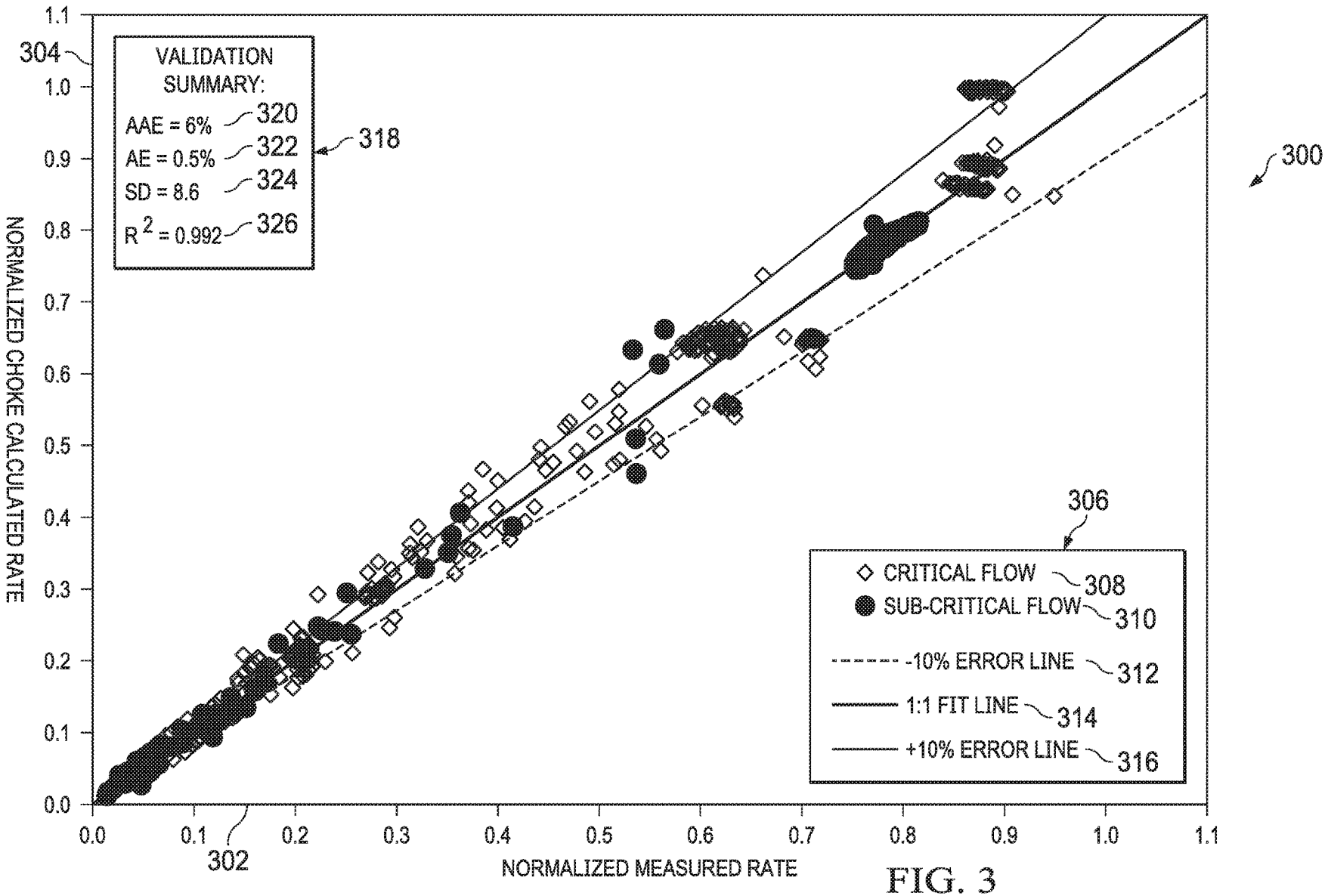
FIG. 3 is a graph plotting example values for a gas rate validation-choke calculated rate versus a three-phase separator test, according to some implementations of the present disclosure.

FIG. 3 is a graph plotting example values 300 for a gas rate validation-choke calculated rate versus a three-phase separator test, according to some implementations of the present disclosure. The values are plotted relative to a normalized measured rate 302 (on the x-axis) and a normalized choke calculated rate 304 (on the y-axis). A legend 306 identifies critical flow plotted points 308, sub-critical flow plotted points 310, a minus-10% error line 312, a 1:1 fit line 314, and a plus-10% error line 316. A legend 318 identifies validation summary values including an AAE percentage 320, an AE percentage 322, an SD percentage 324, and an $R^2$ percentage 326. Numerical values of AAE, AE, SD, and $R^2$ measures of reliability can be used to evaluate the performance of new empirical correlations. In general, the higher the $R^2$ value, the better the model of new empirical correlation fits the actual data. A low standard deviation indicates that the calculated data points using the empirical correlation tend to be close to the expected value or the actual data. In general, the determination of the gas rate using the new empirical correlations can provide high accuracy with low discrepancy, for example, less than 10% error compared to the actual measured data.

Figure 4:
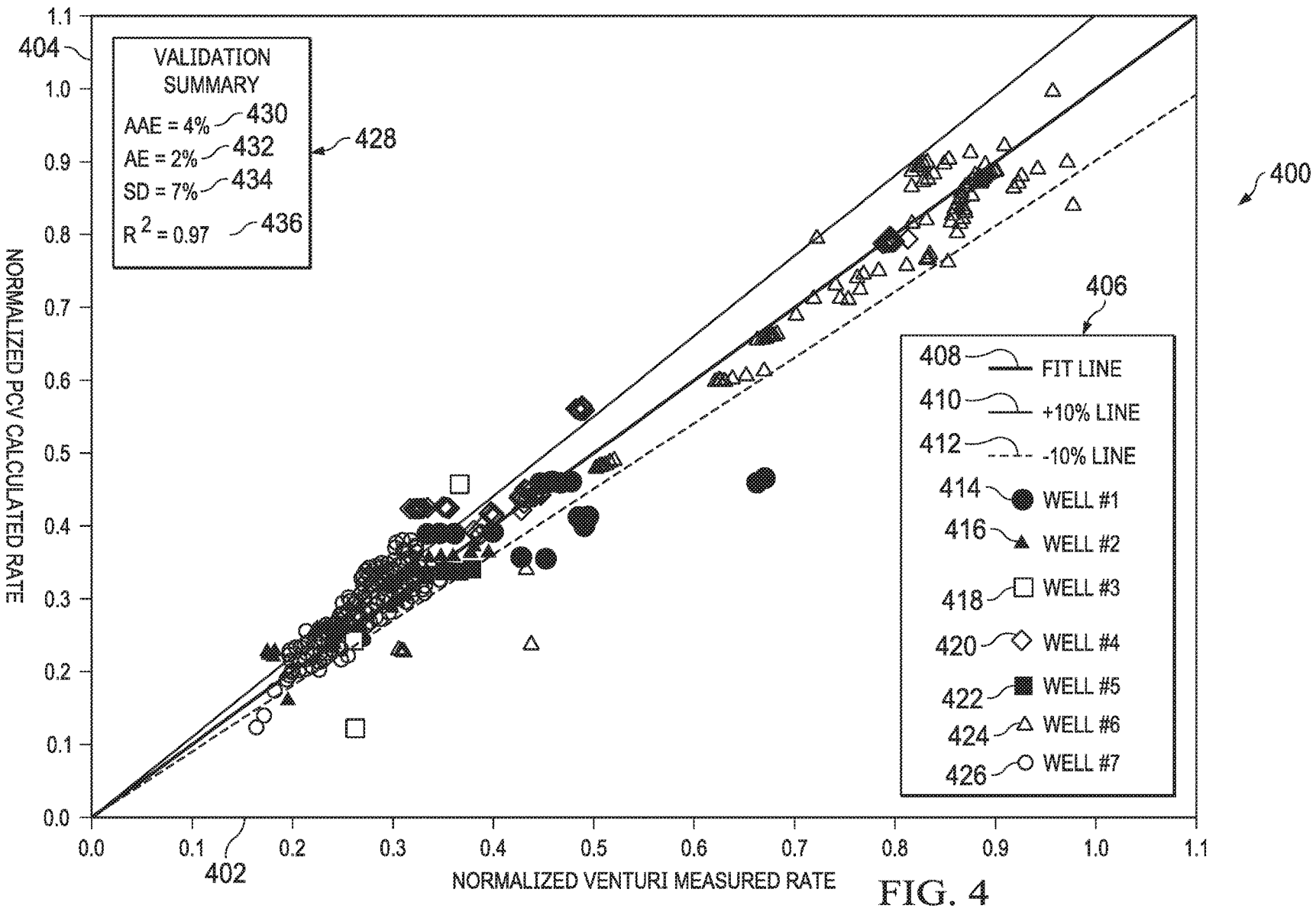
FIG. 4 is a graph plotting example values for a gas rate validation-pressure control valve (PCV) calculated rate versus Venturi meter, according to some implementations of the present disclosure.

FIG. 4 is a graph plotting example values 400 for a gas rate validation—PCV calculated rate versus Venturi meter, according to some implementations of the present disclosure. The values are plotted relative to a normalized Venturi measured rate 402 (on the x-axis) and a normalized PCV calculated rate 404 (on the y-axis). A legend 406 identifies a fit line 408, a plus-10% error line 410, a minus-10% error line 412, and plotted points 414-426 for wells 1-7, respectively. A legend 428 identifies validation summary values including an AAE percentage 430, an AE percentage 432, an SD percentage 434, and an $R^2$ percentage 436.

Figure 5:
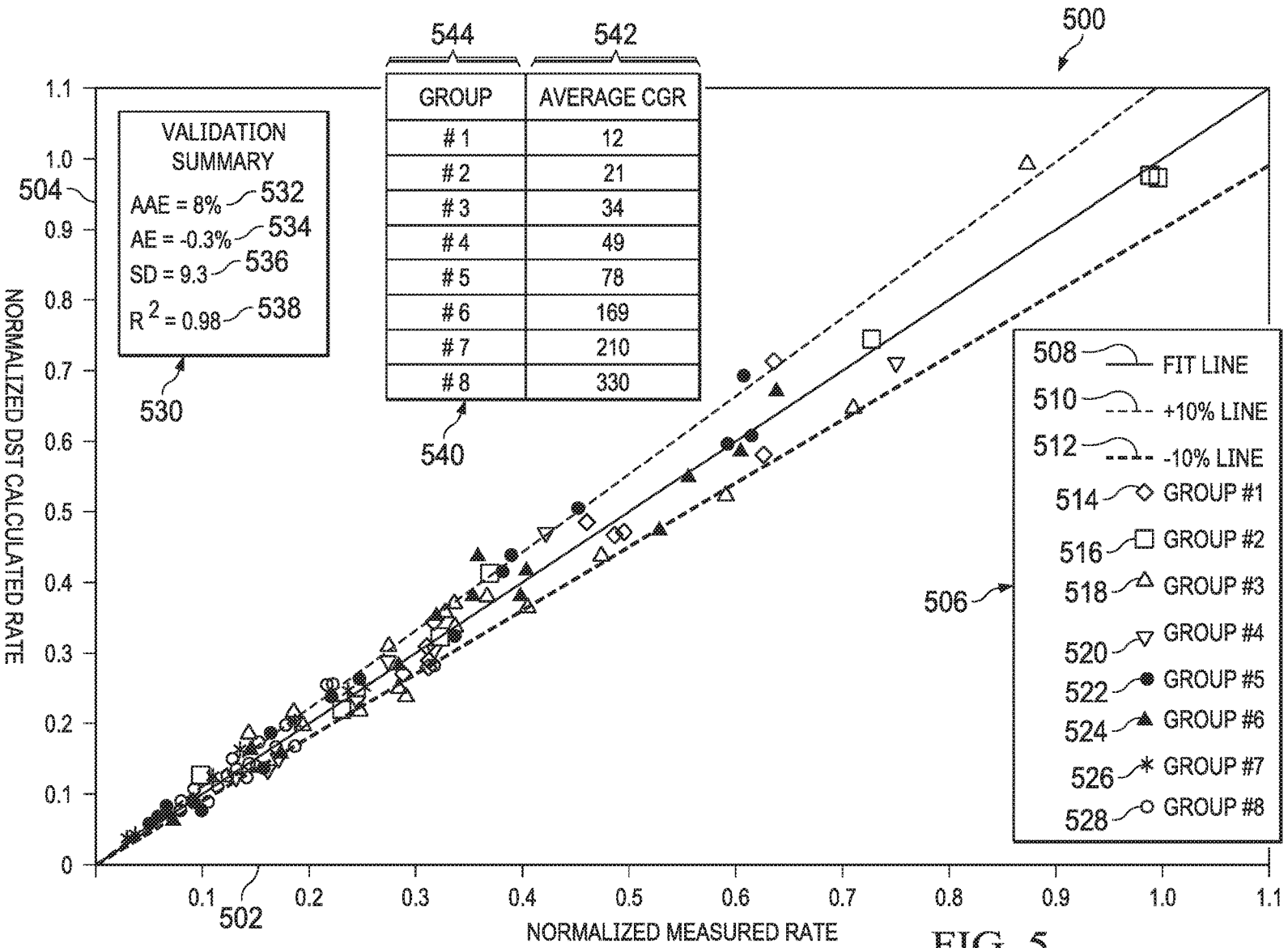
FIG. 5 is a graph plotting example values for a gas rate validation-downstream temperature (DST) calculated rate versus a three-phase separator test, according to some implementations of the present disclosure.

FIG. 5 is a graph plotting example values 500 for a gas rate validation-DST calculated rate versus a three-phase separator test, according to some implementations of the present disclosure. The values are plotted relative to a normalized measured rate 502 (on the x-axis) and a normalized DST calculated rate 504 (on the y-axis). A legend 506 identifies a fit line 508, a plus-10% error line 510, a minus-10% error line 512, and plotted points 514-528 for groups 1-8, respectively. A legend 530 identifies validation summary values including an AAE percentage 532, an AE percentage 534, an SD percentage 536, and an $R^2$ percentage 538. An average CGR table 540 lists average CGR values 542 for groups 544.

Figure 6:
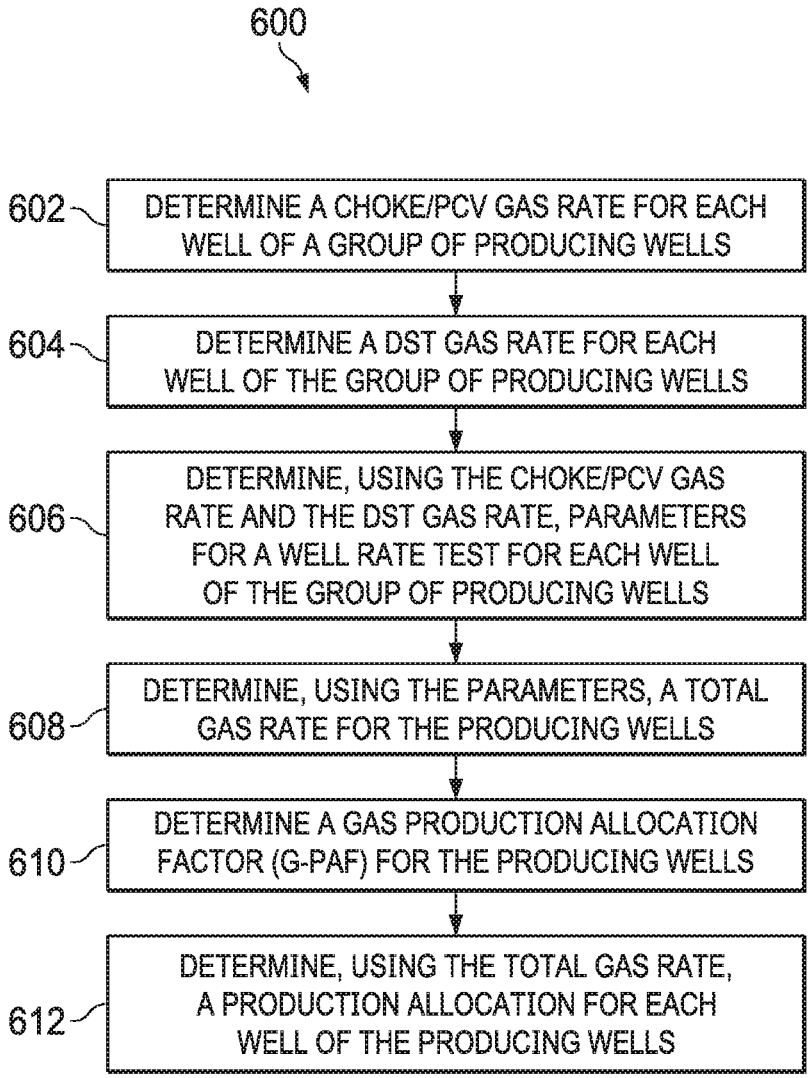
FIG. 6 is a flowchart of an example method for performing continuous daily production allocation, according to some implementations of the present disclosure.

FIG. 6 is a flowchart of an example method 600 for performing continuous daily production allocation, according to some implementations of the present disclosure. For clarity of presentation, the description that follows generally describes method 600 in the context of the other figures in this description. However, it will be understood that method 600 may be performed, for example, by any suitable system, environment, software, and hardware, or a combination of systems, environments, software, and hardware, as appropriate. In some implementations, various steps of method 600 can be run in parallel, in combination, in loops, or in any order.

At 602, a choke/PCV gas rate is determined for each well of a group of producing wells. For example, referring to step 212 of the workflow process 200, the choke gas rate can be calculated as a function of PCV, $P_1$, and $P_2$.

In some implementations, method 600 can further include receiving wellstream values and gas plant values from a PI server. For example, referring to step 202 of the workflow process 200, data can be received in real time from the PI server 128. The data that is received can include the wellstream category 202*a* parameters and the gas plant category 202*b* parameters.

At 604, a DST gas rate is determined for each well of the group of producing wells. As an example, referring to step 214 of the workflow process 200, the DST gas rate can be calculated based on the value of downstream temperature.

At 606, parameters for a well rate test are determined for each well of the group of producing wells using the choke/PCV gas rate and the DST gas rate. For example, referring to step 216 of the workflow process 200, the well rate test values can be defined. A selection for $Q_{G\text{-}RT\ \#1}$ can be based on the reliability of certain values, resulting in using one of the selection alternatives 216*a* through 216*d*.

In some implementations, method 600 can further include updating the parameters for the well rate test when the G-PAF is outside of a pre-determined range. For example, the data verification process that includes steps 206 and 208 of the workflow process 200 can result in execution of step 210 to perform maintenance work for calibrations of $dP_{VM}$, PCV, and T.

At 608, a total gas rate for the producing wells is determined using the parameters. As an example, referring to step 218 of the workflow process 200, the total production can be calculated based on the production of all of the wells 106 using $Q_{GT\text{-}RT}=\Sigma\ (Q_{G\text{-}RT\ \#1}+Q_{G\text{-}RT\ \#2}+Q_{G\text{-}RT\ \#n+1})$.

At 610, a G-PAF for the producing wells is determined. For example, referring to step 218 of the workflow process 200, the gas production allocation factor (G-PAF) can be calculated by dividing $Q_{GT\text{-}RT}$ by $Q_{GT\text{-}GP}$.

At 612, a production allocation for each well of the producing wells is determined using the total gas rate. As an example, referring to step 222 of the workflow process 200, the actual allocated gas production for each individual well ($Q_{G\text{-}Alloc}$) can be prorated based on the total well rate test and the total actual production multiplied by the rate test for each well.

Figure 7:
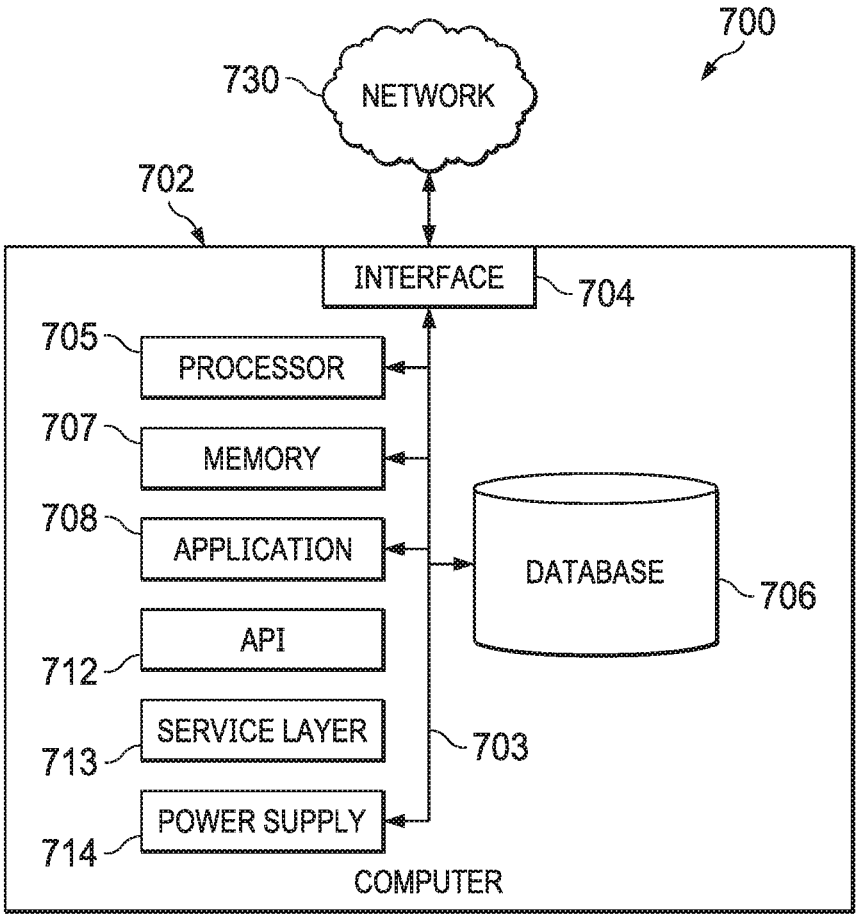
FIG. 7 is a block diagram illustrating an example computer system used to provide computational functionalities associated with described algorithms, methods, functions, processes, flows, and procedures as described in the instant disclosure, according to some implementations of the present disclosure.

FIG. 7 is a block diagram of an example computer system 700 used to provide computational functionalities associated with described algorithms, methods, functions, processes, flows, and procedures, as described in the instant disclosure, according to some implementations of the present disclosure. The illustrated computer 702 is intended to encompass any computing device such as a server, desktop computer, laptop/notebook computer, wireless data port, smart phone, personal data assistant (PDA), tablet computing device, one or more processors within these devices, or any other suitable processing device, including physical or virtual instances (or both) of the computing device. Additionally, the computer 702 may comprise a computer that includes an input device, such as a keypad, keyboard, touch screen, or other device that can accept user information, and an output device that conveys information associated with the operation of the computer 702, including digital data, visual, or audio information (or a combination of information), or a graphical-type user interface (UI) (or GUI).

The computer 702 can serve in a role as a client, network component, a server, a database or other persistency, or any other component (or a combination of roles) of a computer system for performing the subject matter described in the instant disclosure. The illustrated computer 702 is communicably coupled with a network 730. In some implementations, one or more components of the computer 702 may be configured to operate within environments, including cloudcomputing-based, local, global, or other environment (or a combination of environments).

At a high level, the computer 702 is an electronic computing device operable to receive, transmit, process, store, or manage data and information associated with the described subject matter. According to some implementations, the computer 702 may also include or be communicably coupled with an application server, email server, web server, caching server, streaming data server, or other server (or a combination of servers).

The computer 702 can receive requests over network 730 from a client application (for example, executing on another computer 702) and respond to the received requests by processing the received requests using an appropriate software application(s). In addition, requests may also be sent to the computer 702 from internal users (for example, from a command console or by other appropriate access method), external or third-parties, other automated applications, as well as any other appropriate entities, individuals, systems, or computers.

Each of the components of the computer 702 can communicate using a system bus 703. In some implementations, any or all of the components of the computer 702, hardware or software (or a combination of both hardware and software), may interface with each other or the interface 704 (or a combination of both), over the system bus 703 using an application programming interface (API) 712 or a service layer 713 (or a combination of the API 712 and service layer 713). The API 712 may include specifications for routines, data structures, and object classes. The API 712 may be either computer-language independent or dependent and refer to a complete interface, a single function, or even a set of APIs. The service layer 713 provides software services to the computer 702 or other components (whether or not illustrated) that are communicably coupled to the computer 702. The functionality of the computer 702 may be accessible for all service consumers using this service layer. Software services, such as those provided by the service layer 713, provide reusable, defined functionalities through a defined interface. For example, the interface may be software written in JAVA, C++, or other suitable language providing data in extensible markup language (XML) format or other suitable format. While illustrated as an integrated component of the computer 702, alternative implementations may illustrate the API 712 or the service layer 713 as stand-alone components in relation to other components of the computer 702 or other components (whether or not illustrated) that are communicably coupled to the computer 702. Moreover, any or all parts of the API 712 or the service layer 713 may be implemented as child or sub-modules of another software module, enterprise application, or hardware module without departing from the scope of this disclosure.

The computer 702 includes an interface 704. Although illustrated as a single interface 704 in FIG. 7, two or more interfaces 704 may be used according to particular needs, desires, or particular implementations of the computer 702. The interface 704 is used by the computer 702 for communicating with other systems that are connected to the network 730 (whether illustrated or not) in a distributed environment. Generally, the interface 704 comprises logic encoded in software or hardware (or a combination of software and hardware) and is operable to communicate with the network 730. More specifically, the interface 704 may comprise software supporting one or more communication protocols associated with communications such that the network 730 or interface's hardware is operable to communicate physical signals within and outside of the illustrated computer 702.

The computer 702 includes a processor 705. Although illustrated as a single processor 705 in FIG. 7, two or more processors may be used according to particular needs, desires, or particular implementations of the computer 702. Generally, the processor 705 executes instructions and manipulates data to perform the operations of the computer 702 and any algorithms, methods, functions, processes, flows, and procedures as described in the instant disclosure.

The computer 702 also includes a database 706 that can hold data for the computer 702 or other components (or a combination of both) that can be connected to the network 730 (whether illustrated or not). For example, database 706 can be an in-memory, conventional, or other type of database storing data consistent with this disclosure. In some implementations, database 706 can be a combination of two or more different database types (for example, a hybrid in-memory and conventional database) according to particular needs, desires, or particular implementations of the computer 702 and the described functionality. Although illustrated as a single database 706 in FIG. 7, two or more databases (of the same or combination of types) can be used according to particular needs, desires, or particular implementations of the computer 702 and the described functionality. While database 706 is illustrated as an integral component of the computer 702, in alternative implementations, database 706 can be external to the computer 702.

The computer 702 also includes a memory 707 that can hold data for the computer 702 or other components (or a combination of both) that can be connected to the network 730 (whether illustrated or not). Memory 707 can store any data consistent with this disclosure. In some implementations, memory 707 can be a combination of two or more different types of memory (for example, a combination of semiconductor and magnetic storage) according to particular needs, desires, or particular implementations of the computer 702 and the described functionality. Although illustrated as a single memory 707 in FIG. 7, two or more memories 707 (of the same or combination of types) can be used according to particular needs, desires, or particular implementations of the computer 702 and the described functionality. While memory 707 is illustrated as an integral component of the computer 702, in alternative implementations, memory 707 can be external to the computer 702.

The application 708 is an algorithmic software engine providing functionality according to particular needs, desires, or particular implementations of the computer 702, particularly with respect to functionality described in this disclosure. For example, application 708 can serve as one or more components, modules, or applications. Further, although illustrated as a single application 708, the application 708 may be implemented as multiple applications 708 on the computer 702. In addition, although illustrated as integral to the computer 702, in alternative implementations, the application 708 can be external to the computer 702.

The computer 702 can also include a power supply 714. The power supply 714 can include a rechargeable or non-rechargeable battery that can be configured to be either user- or non-user-replaceable. In some implementations, the power supply 714 can include power-conversion or management circuits (including recharging, standby, or other power management functionality). In some implementations, the power-supply 714 can include a power plug to allow the computer 702 to be plugged into a wall socket or other power source to, for example, power the computer 702 or recharge a rechargeable battery.

There may be any number of computers 702 associated with, or external to, a computer system containing computer 702, each computer 702 communicating over network 730. Further, the term "client," "user," and other appropriate terminology may be used interchangeably, as appropriate, without departing from the scope of this disclosure. Moreover, this disclosure contemplates that many users may use one computer 702, or that one user may use multiple computers 702.

Described implementations of the subject matter can include one or more features, alone or in combination.

For example, in a first implementation, a computer-implemented method, comprising: determining a choke/pressure control valve (PCV) gas rate for each well of a group of producing wells; determining a downstream temperature (DST) gas rate for each well of the group of producing wells; determining, using the choke/PCV gas rate and the DST gas rate, parameters for a well rate test for each well of the group of producing wells; determining, using the parameters, a total gas rate for the producing wells; determining a gas production allocation factor (G-PAF) for the producing wells; and determining, using the total gas rate, a production allocation for each well of the producing wells.

The foregoing and other described implementations can each, optionally, include one or more of the following features:

A first feature, combinable with any of the following features, the method further comprising updating the parameters for the well rate test when the G-PAF is outside of a pre-determined range.

A second feature, combinable with any of the previous or following features, the method further comprising receiving wellstream values and gas plant values from a plant information (PI) server.

A third feature, combinable with any of the previous or following features, wherein the wellstream values include a flowing wellhead pressure, a choke or PCV, a line pressure, a flowrate of a Venturi meter, and a downstream temperature (DST).

A fourth feature, combinable with any of the previous or following features, wherein the gas plant parameters include a gas plant rate.

A fifth feature, combinable with any of the previous or following features, the method further comprising further comprising: determining if at least one of the wellstream parameters is unreliable; and updating values of the wellstream parameters.

A sixth feature, combinable with any of the previous or following features, wherein the pre-determined range is 0.9 to 1.1.

In a second implementation, a non-transitory, computer-readable medium storing one or more instructions executable by a computer system to perform operations comprising: determining a PCV gas rate for each well of a group of producing wells; determining a choke/DST gas rate for each well of the group of producing wells; determining, using the choke/PCV gas rate and the DST gas rate, parameters for a well rate test for each well of the group of producing wells; determining, using the parameters, a total gas rate for the producing wells; determining a G-PAF for the producing wells; and determining, using the total gas rate, a production allocation for each well of the producing wells.

The foregoing and other described implementations can each, optionally, include one or more of the following features:

A first feature, combinable with any of the following features, the operations further comprising updating the parameters for the well rate test when the G-PAF is outside of a pre-determined range.

A second feature, combinable with any of the previous or following features, the operations further comprising receiving wellstream values and gas plant values from a plant information (PI) server.

A third feature, combinable with any of the previous or following features, wherein the wellstream values include a flowing wellhead pressure, a choke or PCV, a line pressure, a flowrate of a Venturi meter, and a DST.

A fourth feature, combinable with any of the previous or following features, wherein the gas plant parameters include a gas plant rate.

A fifth feature, combinable with any of the previous or following features, the operations further comprising further comprising: determining if at least one of the wellstream parameters is unreliable; and updating values of the wellstream parameters.

A sixth feature, combinable with any of the previous or following features, wherein the pre-determined range is 0.9 to 1.1.

In a third implementation, a computer-implemented system, comprising one or more processors and a non-transitory computer-readable storage medium coupled to the one or more processors and storing programming instructions for execution by the one or more processors, the programming instructions instructing the one or more processors to perform operations comprising: determining a choke/PCV gas rate for each well of a group of producing wells; determining a DST gas rate for each well of the group of producing wells; determining, using the choke/PCV gas rate and the DST gas rate, parameters for a well rate test for each well of the group of producing wells; determining, using the parameters, a total gas rate for the producing wells; determining a gas production allocation factor (G-PAF) for the producing wells; and determining, using the total gas rate, a production allocation for each well of the producing wells.

The foregoing and other described implementations can each, optionally, include one or more of the following features:

A first feature, combinable with any of the following features, the operations further comprising updating the parameters for the well rate test when the G-PAF is outside of a pre-determined range.

A second feature, combinable with any of the previous or following features, the operations further comprising receiving wellstream values and gas plant values from a plant information (PI) server.

A third feature, combinable with any of the previous or following features, wherein the wellstream values include a flowing wellhead pressure, a choke or PCV, a line pressure, a flowrate of a Venturi meter, and a DST).

A fourth feature, combinable with any of the previous or following features, wherein the gas plant parameters include a gas plant rate.

A fifth feature, combinable with any of the previous or following features, the operations further comprising further comprising: determining if at least one of the wellstream parameters is unreliable; and updating values of the wellstream parameters.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal, for example, a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be, or further include special purpose logic circuitry, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) may be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, IOS, or any other suitable conventional operating system.

A computer program, which may also be referred to or described as a program, software, a software application, a module, a software module, a script, or code can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network. While portions of the programs illustrated in the various figures are shown as individual modules that implement the various features and functionality through various objects, methods, or other processes, the programs may instead include a number of sub-modules, third-party services, components, libraries, and such, as appropriate. Conversely, the features and functionality of various components can be combined into single components, as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on general or special purpose microprocessors, both, or any other kind of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable storage device, for example, a universal serial bus (USB) flash drive, to name just a few.

Computer-readable media (transitory or non-transitory, as appropriate) suitable for storing computer program instructions and data includes all forms of permanent/non-permanent or volatile/non-volatile memory, media and memory devices, including by way of example semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices; magnetic devices, for example, tape, cartridges, cassettes, internal/removable disks; magneto-optical disks; and optical memory devices, for example, digital video disc (DVD), CD-ROM, DVD+/−R, DVD-RAM, DVD-ROM, HD-DVD, and BLURAY, and other optical memory technologies. The memory may store various objects or data, including caches, classes, frameworks, applications, modules, backup data, jobs, web pages, web page templates, data structures, database tables, repositories storing dynamic information, and any other appropriate information including any parameters, variables, algorithms, instructions, rules, constraints, or references thereto. Additionally, the memory may include any other appropriate data, such as logs, policies, security or access data, reporting files, as well as others. The processor and the memory can be supplemented by, or incorporated in, special purpose logic circuitry.

To provide for interaction with a user, implementations of the subject matter described in this specification can be implemented on a computer having a display device, for example, a cathode ray tube (CRT), liquid crystal display (LCD), light-emitting diode (LED), or plasma monitor, for displaying information to the user and a keyboard and a pointing device, for example, a mouse, trackball, or trackpad by which the user can provide input to the computer. Input may also be provided to the computer using a touchscreen, such as a tablet computer surface with pressure sensitivity, a multi-touch screen using capacitive or electric sensing, or other type of touchscreen. Other kinds of devices can be used to provide for interaction with a user as well; for example, feedback provided to the user can be any form of sensory feedback, for example, visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

The term "graphical user interface," or "GUI," may be used in the singular or the plural to describe one or more graphical user interfaces and each of the displays of a particular graphical user interface. Therefore, a GUI may represent any graphical user interface, including but not limited to, a web browser, a touch screen, or a command line interface (CLI) that processes information and efficiently presents the information results to the user. In general, a GUI may include a plurality of user interface (UI) elements, some or all associated with a web browser, such as interactive fields, pull-down lists, and buttons. These and other UI elements may be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with some implementations of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with this disclosure), all or a portion of the Internet, or any other communication system or systems at one or more locations (or a combination of communication networks). The network may communicate with, for example, Internet Protocol (IP) packets, Frame Relay frames, Asynchronous Transfer Mode (ATM) cells, voice, video, data, or other suitable information (or a combination of communication types) between network addresses.

The computing system can include clients and servers. A client and server are generally remote from each other and typically interact through a communication network. The relationship of client and server arises by virtue of computer programs running on the respective computers and having a client-server relationship to each other.

Cluster file systems used in techniques of the present disclosure can be any file system type accessible from multiple servers for read and update. Locking or consistency tracking is not necessary since the locking of exchange file system can be done at application layer. Furthermore, Unicode data files are different from non-Unicode data files.

While this specification contains many specific implementation details, these should not be construed as limitations on the scope of the present disclosure or on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain this disclosure. Other changes, substitutions, and alterations are also possible without departing from the spirit and scope of this disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A computer-implemented method implemented using one or more computers, comprising:

receiving, by the one or more computers, wellstream values and gas plant parameters from a plant information (PI) server, including receiving a flowrate of a Venturi meter;

determining, using the one or more computers, a choke/pressure control valve (PCV) gas rate for each well of a group of producing wells;

determining, using the one or more computers, a downstream temperature (DST) gas rate for each well of the group of producing wells;

determining, using the choke/PCV gas rate and the DST gas rate, gas plant parameters for a well rate test for each well of the group of producing wells, wherein the gas plant parameters are determined based on a reliability of values from the choke/PCV gas rate and the DST gas rate, wherein the reliability is based on flowing conditions of the group of producing wells, and wherein an unreliability exists if the flowrate of the Venturi meter is zero or above a given flowrate;

determining, using the one or more computers and the gas plant parameters, a total gas rate for the producing wells;

determining, using the one or more computers, a gas production allocation factor (G-PAF) for the producing wells; and determining, using the one or more computers and the total gas rate, a production allocation for each well of the producing wells as a mathematical function of the total gas rate and the gas production allocation factor.

2. The computer-implemented method of claim 1, further comprising updating the gas plant parameters for the well rate test when the G-PAF is outside of a pre-determined range.

3. The computer-implemented method of claim 1, wherein the wellstream values include a flowing wellhead pressure, a choke or PCV, a line pressure, and a downstream temperature (DST).

4. The computer-implemented method of claim 1, wherein the gas plant parameters include a gas plant rate.

5. The computer-implemented method of claim 1, further comprising:

determining if at least one of the gas plant parameters is unreliable; and updating values of the gas plant parameters.

6. The computer-implemented method of claim 2, wherein the pre-determined range is a numeric value from 0.9 to 1.1.

7. A non-transitory, computer-readable medium storing one or more instructions executable by a computer system and implemented using one or more computers to perform operations comprising:

receiving, by the one or more computers, wellstream values and gas plant parameters from a plant information (PI) server, including receiving a flowrate of a Venturi meter;

determining, using the one or more computers, a choke/pressure control valve (PCV) gas rate for each well of a group of producing wells;

determining, using the one or more computers, a downstream temperature (DST) gas rate for each well of the group of producing wells;

determining, using the choke/PCV gas rate and the DST gas rate, parameters for a well rate test for each well of the group of producing wells, wherein the gas plant parameters are determined based on a reliability of values from the choke/PCV gas rate and the DST gas rate, wherein the reliability is based on flowing conditions of the group of producing wells, and wherein an unreliability exists if the flowrate of the Venturi meter is zero or above a given flowrate;

determining, using the one or more computers and the parameters, a total gas rate for the producing wells;

determining, using the one or more computers, a gas production allocation factor (G-PAF) for the producing wells; and determining, using the one or more computers and the total gas rate, a production allocation for each well of the producing wells.

8. The non-transitory, computer-readable medium of claim 7, further comprising updating the parameters for the well rate test when the G-PAF is outside of a pre-determined range.

9. The non-transitory, computer-readable medium of claim 7, wherein the wellstream values include a flowing wellhead pressure, a choke or PCV, a line pressure, and a downstream temperature (DST).

10. The non-transitory, computer-readable medium of claim 7, wherein the gas plant parameters include a gas plant rate.

11. The non-transitory, computer-readable medium of claim 7, the operations further comprising:

determining if at least one of the wellstream parameters is unreliable; and updating values of the wellstream parameters.

12. The non-transitory, computer-readable medium of claim 8, wherein the pre-determined range is 0.9 to 1.1.

13. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

receiving wellstream values and gas plant parameters from a plant information (PI) server, including receiving a flowrate of a Venturi meter;

determining a PCV gas rate for each well of a group of producing wells;

determining a DST gas rate for each well of the group of producing wells;

determining, using the choke/PCV gas rate and the DST gas rate, parameters for a well rate test for each well of the group of producing wells, wherein the gas plant parameters are determined based on a reliability of values from the choke/PCV gas rate and the DST gas rate, wherein the reliability is based on flowing conditions of the group of producing wells, and wherein an unreliability exists if the flowrate of the Venturi meter is zero or above a given flowrate;

determining, using the parameters, a total gas rate for the producing wells;

determining a G-PAF for the producing wells; and determining, using the total gas rate, a production allocation for each well of the producing wells.

14. The computer-implemented system of claim 13, further comprising updating the parameters for the well rate test when the G-PAF is outside of a pre-determined range.

15. The computer-implemented system of claim 13, wherein the wellstream values include a flowing wellhead pressure, a choke or PCV, a line pressure, and a downstream temperature (DST).

16. The computer-implemented system of claim 13, wherein the gas plant parameters include a gas plant rate.

17. The computer-implemented system of claim 13, the operations further comprising:

determining if at least one of the wellstream parameters is unreliable; and updating values of the wellstream parameters.

* * * * *